US011053955B2

(12) United States Patent
Beaman et al.

(10) Patent No.: US 11,053,955 B2
(45) **Date of Patent: *Jul. 6, 2021**

(54) CEILING FAN HANGER BRACKET AND RECEIVER

(71) Applicant: Home Depot Product Authority, LLC, Atlanta, GA (US)

(72) Inventors: Brett D. Beaman, Atlanta, GA (US); Adam Russell Green, Marietta, GA (US); Richard A. Pulliam, Acworth, GA (US)

(73) Assignee: HOME DEPOT PRODUCT AUTHORITY, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/820,959

(22) Filed: Mar. 17, 2020

(65) Prior Publication Data

US 2020/0217331 A1 Jul. 9, 2020

Related U.S. Application Data

(63) Continuation of application No. 15/894,468, filed on Feb. 12, 2018, now Pat. No. 10,590,960.
(Continued)

(51) Int. Cl.
*F04D 29/64* (2006.01)
*F04D 27/00* (2006.01)
(Continued)

(52) U.S. Cl.
CPC ..... *F04D 29/646* (2013.01); *F04D 13/0693* (2013.01); *F04D 25/068* (2013.01);
(Continued)

(58) Field of Classification Search
CPC .... F04D 29/646; F04D 13/0693; F04D 27/00; F04D 25/088; F21V 33/0096; F21V 23/003
(Continued)

(56) References Cited

U.S. PATENT DOCUMENTS 5,613,832 A 3/1997 Su
5,947,436 A 9/1999 Bucher et al.
(Continued)

FOREIGN PATENT DOCUMENTS

CN 101368577 A 2/2009

OTHER PUBLICATIONS

Chinese Patent Office, First Office Action and Search Report issued in CN Application No. 201810538640.6, dated Aug. 4, 2020, 10 pgs.

*Primary Examiner* — Muhammad Ijaz
(74) *Attorney, Agent, or Firm* — Greenberg Traurig, LLP

(57) ABSTRACT

A hanging bracket for supporting a suspended apparatus and a control unit housing includes a base having a first end and a second end. The first end includes a first surface and a first screw boss therethrough, and the second end includes a second surface and a second screw boss therethrough. The bracket also includes a support portion vertically spaced from the base, where the support portion adapted to support the suspended apparatus, and a neck extending between the base and the support portion. At least the first surface of the first end of the base, the second surface of the second end of the base, and the first and second screw bosses collectively form an interface configured for juxtaposition with complementary surfaces and screw holes of the control unit housing.

24 Claims, 6 Drawing Sheets

Related U.S. Application Data

(60) Provisional application No. 62/512,691, filed on May 30, 2017.

(51) Int. Cl.

| | |
|---|---|
| ***F04D 25/08*** | (2006.01) |
| ***F21V 23/00*** | (2015.01) |
| ***F04D 13/06*** | (2006.01) |
| ***F04D 29/60*** | (2006.01) |
| ***F04D 25/06*** | (2006.01) |
| *F21V 33/00* | (2006.01) |

(52) U.S. Cl.
CPC ..... *F04D 25/088* (2013.01); *F04D 27/00* (2013.01); *F04D 29/601* (2013.01); *F21V 23/003* (2013.01); *F21V 33/0096* (2013.01)

(58) Field of Classification Search
USPC ..... 248/342, 343, 344
See application file for complete search history.

(56) References Cited

U.S. PATENT DOCUMENTS

| | | | | |
|---|---|---|---|---|
| 6,042,072 | A * | 3/2000 | Chi-Nan | F04D 25/088 248/222.52 |
| 6,171,061 | B1 | 1/2001 | Hsu | |
| 6,203,279 | B1 | 3/2001 | Moody et al. | |
| 6,280,145 | B1 | 8/2001 | Liu | |
| 6,325,654 | B1 | 12/2001 | Kerr, Jr. et al. | |
| 6,761,540 | B2 | 7/2004 | Tseng | |
| 6,877,703 | B2 | 4/2005 | Tang | |
| 6,981,678 | B2 | 1/2006 | Fu-Liang | |
| 7,028,963 | B1 | 4/2006 | Silva et al. | |
| D532,098 | S | 11/2006 | Hidalgo | |
| D535,015 | S | 1/2007 | Gajewski | |
| 7,261,520 | B2 | 8/2007 | Wang | |
| 7,462,775 | B1 | 12/2008 | Gretz | |
| 7,510,160 | B1 | 3/2009 | Wang | |
| 7,527,232 | B2 | 5/2009 | Frampton et al. | |
| 7,621,498 | B2 * | 11/2009 | Tang | F04D 29/60 248/317 |
| D632,780 | S | 2/2011 | Pan | |
| 8,215,920 | B2 | 7/2012 | Criner et al. | |
| 8,336,844 | B2 | 12/2012 | Pearce | |
| 8,353,675 | B2 | 1/2013 | Lin | |
| 9,394,919 | B1 | 7/2016 | Byrne et al. | |
| 9,453,517 | B1 | 9/2016 | Burns et al. | |
| 9,587,518 | B2 * | 3/2017 | Oleson | F04D 29/601 |
| 10,415,575 | B2 * | 9/2019 | Horng | F04D 29/601 |
| 2003/0067779 | A1 | 4/2003 | Po | |
| 2003/0147749 | A1 | 8/2003 | Kerr, Jr. | |
| 2004/0256531 | A1 | 12/2004 | Tang | |
| 2005/0006549 | A1 | 1/2005 | Liu | |
| 2005/0077446 | A1 | 4/2005 | Bacon et al. | |
| 2008/0181783 | A1 | 7/2008 | Pearce | |
| 2008/0224013 | A1 * | 9/2008 | Huang | F04D 29/646 248/343 |
| 2009/0026326 | A1 | 1/2009 | Li | |
| 2009/0214353 | A1 * | 8/2009 | Ko | F04D 29/601 416/244 R |
| 2010/0221120 | A1 * | 9/2010 | Lin | F04D 29/601 416/244 R |
| 2011/0031367 | A1 | 2/2011 | Wang | |
| 2011/0031368 | A1 | 2/2011 | Wang | |
| 2012/0305743 | A1 | 12/2012 | Kerr, Jr. et al. | |
| 2014/0353459 | A1 | 12/2014 | Kerr, Jr. et al. | |
| 2015/0090858 | A1 | 4/2015 | Broughman et al. | |
| 2015/0338726 | A1 * | 11/2015 | Kadotani | G03B 21/16 353/57 |
| 2016/0047391 | A1 | 2/2016 | McPherson et al. | |
| 2016/0111816 | A1 | 4/2016 | Walker et al. | |
| 2017/0051759 | A1 | 2/2017 | Zauhar et al. | |
| 2018/0347590 | A1 * | 12/2018 | Beaman | F04D 25/068 |
| 2019/0120248 | A1 * | 4/2019 | Whitmire | F04D 25/088 |
| 2019/0309761 | A1 | 10/2019 | Wang | |
| 2019/0317577 | A1 | 10/2019 | Lin et al. | |

* cited by examiner

CEILING FAN HANGER BRACKET AND RECEIVER

CROSS-REFERENCE TO RELATED APPLICATIONS

This application is a continuation of U.S. application Ser. No. 15/894,468, filed on Feb. 12, 2018, which claims the benefit of U.S. Provisional Application No. 62/512,691 filed on May 30, 2017, the entireties of which are incorporated by reference herein.

FIELD OF THE DISCLOSURE

The present description relates generally to support systems for hanging apparatuses, and more specifically to ceiling fan hanger brackets and control units.

BACKGROUND

As technology advances, it is becoming increasingly common that objects within a home—such as appliances, furniture, and fixtures—integrate electronics that enhance the operation and/or control of those objects. Despite the addition of such electronic components, consumers tend to prefer that the aesthetic qualities of these objects remain unchanged with respect to previous iterations thereof. Thus, new challenges have arisen involving the design and construction of objects with additional or enhanced functionality, while simultaneously not compromising the favorable aesthetics of those objects.

SUMMARY

According to one aspect of the present invention, there is provided a hanging bracket for supporting a suspended apparatus and a control unit housing includes a base having a first end and a second end. The first end includes a first surface and a first screw boss therethrough, and the second end includes a second surface and a second screw boss therethrough. The bracket also includes a support portion vertically spaced from the base, where the support portion adapted to support the suspended apparatus, and a neck extending between the base and the support portion. At least the first surface of the first end of the base, the second surface of the second end of the base, and the first and second screw bosses collectively form an interface configured for juxtaposition with complementary surfaces and screw holes of the control unit housing.

According to another aspect of the present invention, there is provided a system for supporting a suspended apparatus. The system includes a hanging bracket and a control unit housing. The hanging bracket includes a base having a first end and a second end. The first end includes a first surface and a first screw boss therethrough, and the second end includes a second surface and a second screw boss therethrough. The hanging bracket also includes a support portion vertically spaced from the base, where the support portion adapted to support the suspended apparatus, and a neck extending between the base and the support portion. The control unit housing includes a first section configured for juxtaposition with the first surface of the first end of the base, a second section configured for juxtaposition with the second surface of the second end of the base of the hanging bracket, and screw holes configured for juxtaposition with the first and second screw bosses of the hanging bracket.

The foregoing summary is illustrative only and is not intended to be in any way limiting. In addition to the illustrative aspects, embodiments, and features described above, further aspects embodiments, and features will become apparent by reference to the figures and the following detailed description and the accompanying drawings.

DETAILED DESCRIPTION

Figure 1A:
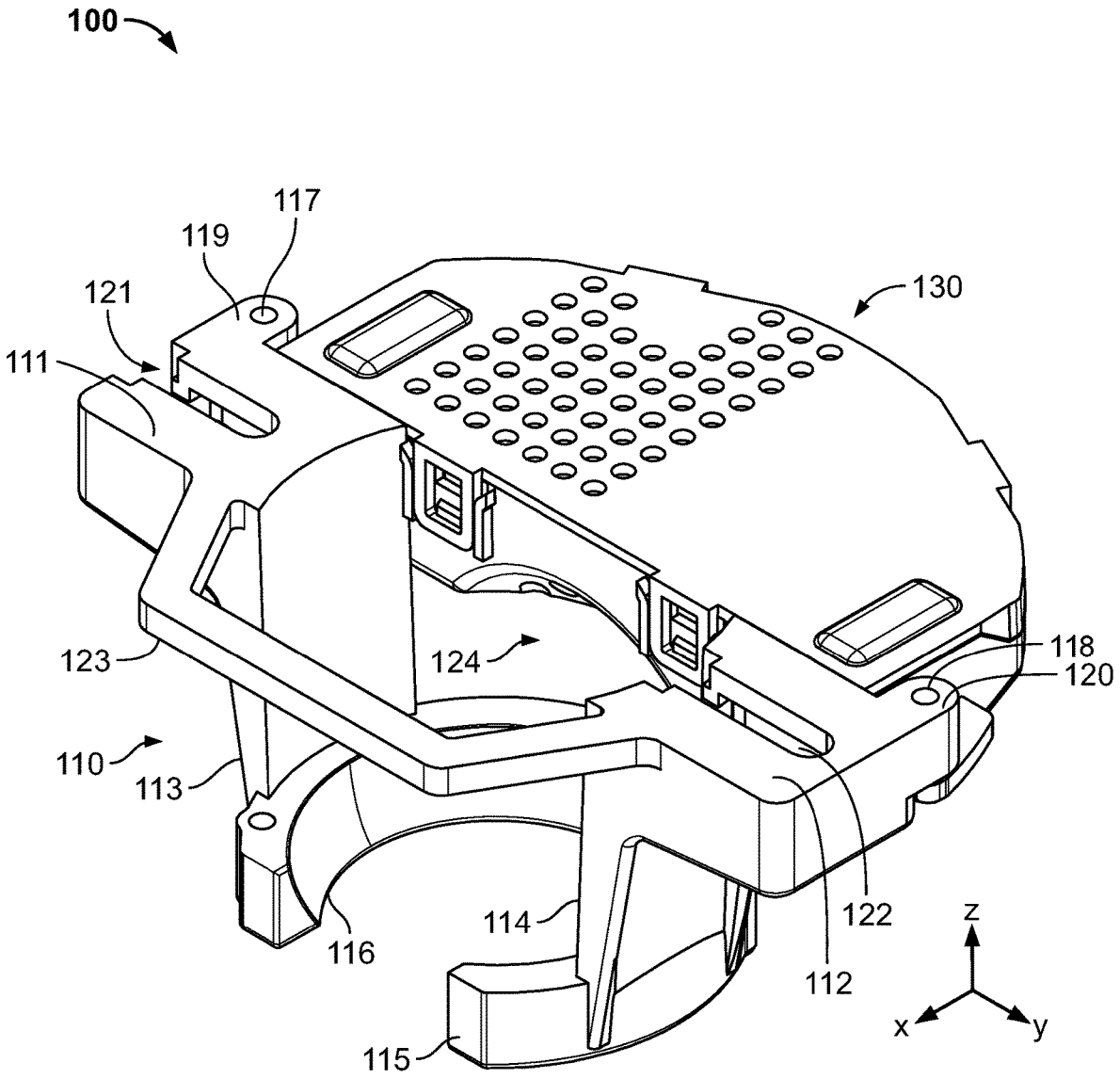
FIG. 1A is a front perspective view of a ceiling fan hanger assembly, according to an example embodiment.
Figure 1B:
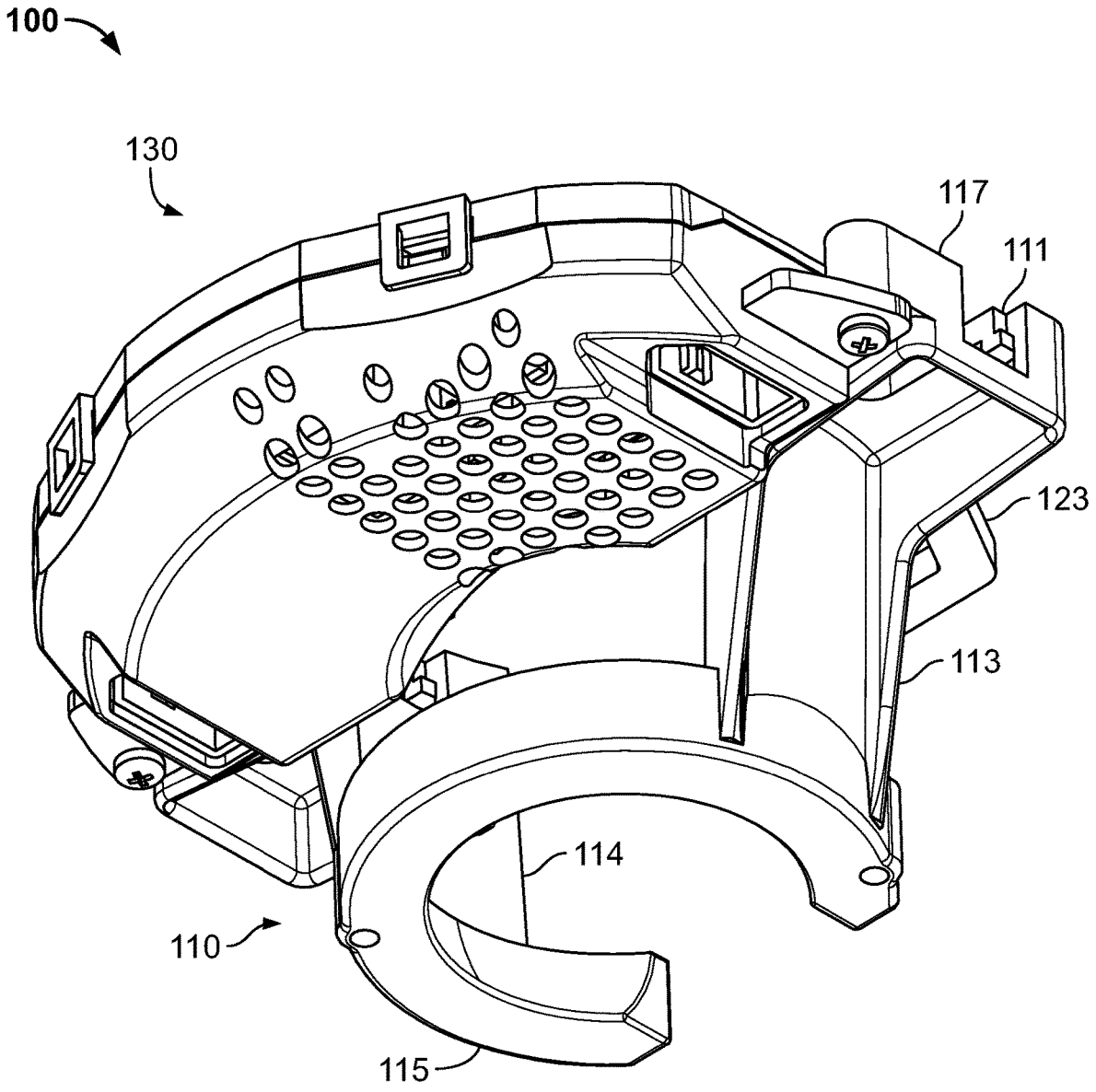
FIG. 1B is a rear perspective view of a ceiling fan hanger assembly, according to an example embodiment.
Figure 1C:
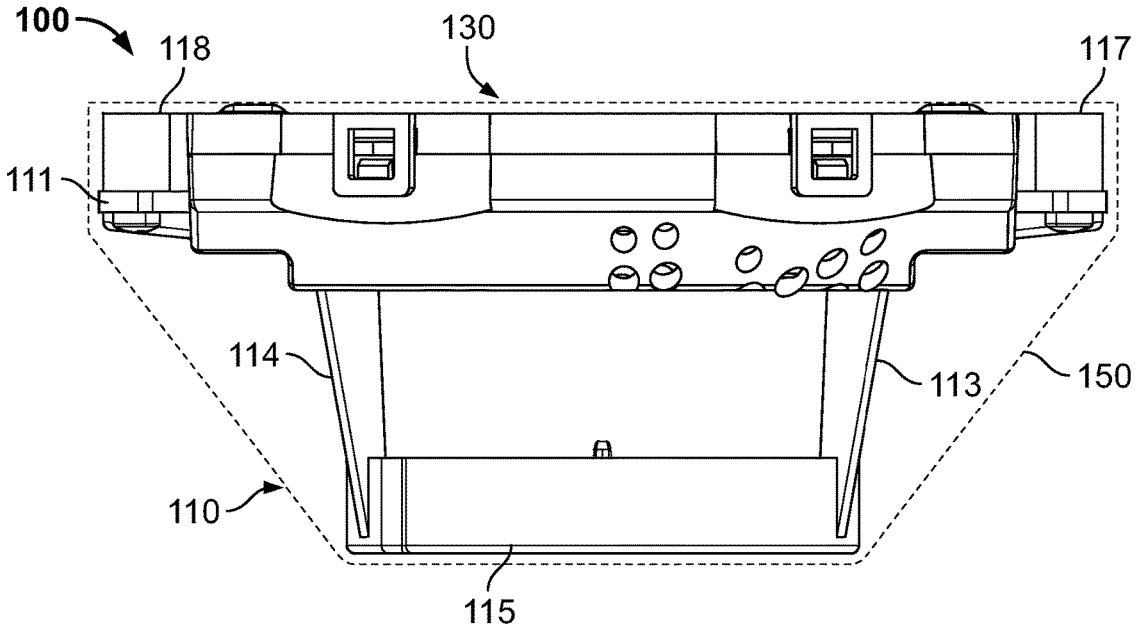
FIG. 1C is an elevated rear view of a ceiling fan hanger assembly, according to an example embodiment.
Figure 1D:
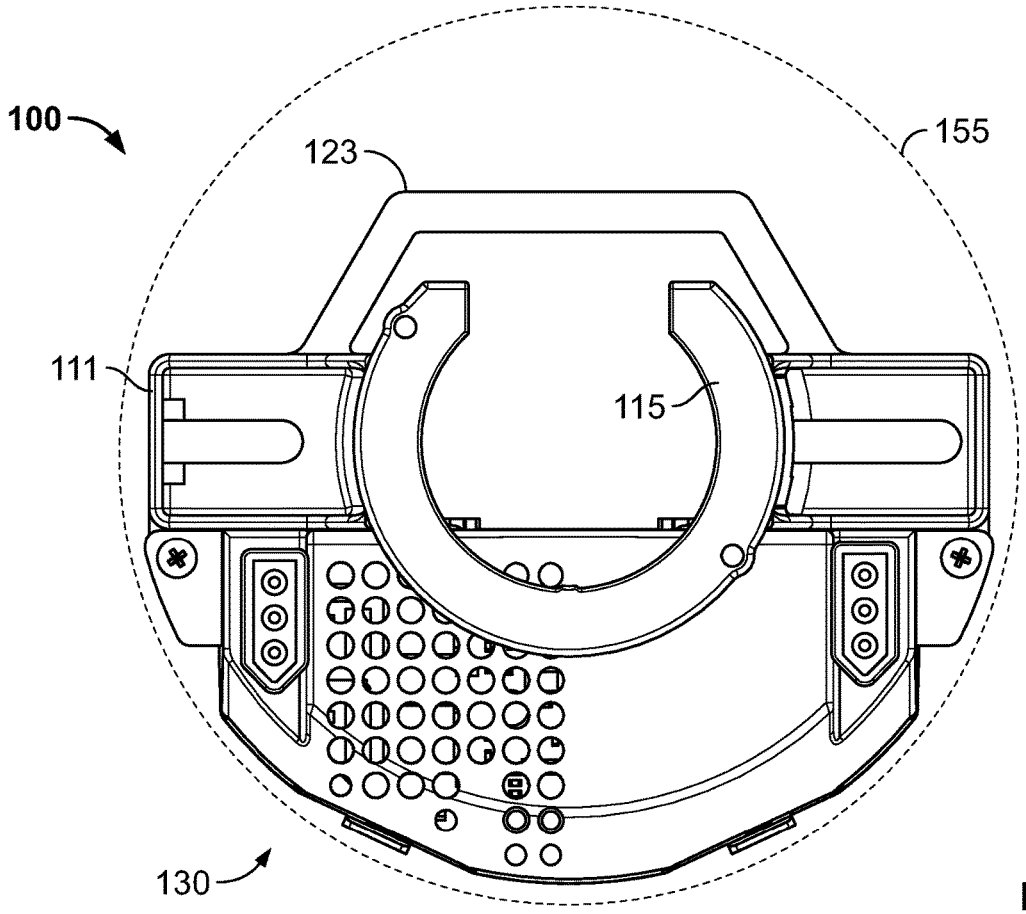
FIG. 1D is an elevated bottom view of a ceiling fan hanger assembly, according to an example embodiment.

The following description of example methods and apparatus is not intended to limit the scope of the description to the precise form or forms detailed herein. Instead the following description is intended to be illustrative so that others may follow its teachings.

Suspending ceiling fans, light fixtures and the like from the ceiling typically involves securing in place a bracket that mounts to support structures within the ceiling. An example arrangement includes a bracket adapted to support a hanger ball and downrod assembly of a ceiling fan. To maintain preferable aesthetics, the exposed portion of the bracket may be obscured by an enclosure, which is often referred to as a "canopy." The shape and size of the canopy tends to be sufficient for covering the exposed portion of the bracket extending through the ceiling.

Ceiling fans are increasingly becoming multi-functional and may include one or more lighting elements and a controllable electric motor, among other elements. Retrofitting existing house wiring to accommodate advanced ceiling fan features can be expensive. To address that issue, newer ceiling fans sometimes include a radio frequency (RF) remote control and an RF receiver installed between the line power and the operational components of the fan, such as the motor and light fixture. Together, the remote control and receiver allow full control of the ceiling fan without having to run additional wiring to the fan junction box. Due to limited space under the ceiling fan canopy, conventional RF receivers are typically wedged into the central negative space of the hanging bracket, e.g. directly between the hanger ball and the wiring aperture of the junction box. Such an arrangement is undesirable, because it can make connecting the ceiling fan wiring awkward, and it can also lead to pinching, crimping and even disconnection of the wires. Additionally, with the advent of the "Internet of things," ceiling fans may be configured with controllable lighting elements (beyond simple on/off control), sensors, and/or other devices. Controlling such devices and facilitating communication to and from such devices may therefore involve the integration of electronic hardware within the ceiling, the hanging bracket, or some other housing integrated therewith.

The present application discloses a system for supporting a suspended apparatus that includes a hanging bracket and a receiver unit or control unit. The hanging bracket includes one or more surfaces that are complementary to respective surfaces of the receiver unit, such that the hanging bracket and receiver unit can be mated together and contained within a canopy. The hanging bracket and the receiver unit include corresponding fasteners—such as screw bosses or holes—that are in alignment when the receiver unit complementarily abuts the hanging bracket and enables them to be rigidly coupled together.

The receiver unit may be adapted to maintain therein electronic components that facilitate the operation and control of a ceiling fan and its controllable elements, among other things. For example, the receiver unit may include electrical components (e.g., transistors, relays, switches, pulse width modulators (PWMs), TRIACs, etc.) that control the speed of a ceiling fan motor or the brightness of a light bulb. The receiver unit may also include electronics that facilitate communications, such as radio transceivers, Wi-Fi modules, Bluetooth modules, and/or other wired or wireless communication means. Regardless of the particular implementation, the receiver unit may house any combination of electrical devices, computing devices, software, or other elements.

The receiver unit may also include one or more physical interfaces, such as connectors or ports. Such physical interfaces may be configured to send and/or receive power (AC or DC power) or communications (e.g., electrical signals). As one example, a connector may be configured for connection with a power line of a user's home, which supplies power to electronic components therein. As another example, a connector may be configured for connection with a wiring harness that extends to the controllable elements within a ceiling fan apparatus (e.g., through a downrod assembly, or along an exposed wiring bundle). The shape and size of such connectors may be proprietary and/or asymmetrical, in some instances, to prevent incorrect wiring and mitigate the potential for user error during installation.

Although example ceiling fan brackets and receiver units are shown and described herein, it should be understood that the shape, size, dimensions, arrangement, or other particular geometric aspects of ceiling fan brackets and receiver units are provided for explanatory purposes. Other implementations not explicitly shown in the present application may apply the principles disclosed herein. Neither the disclosure nor the claims of the present application are limited to the examples shown and described herein. One of ordinary skill would appreciate that deviations from the examples can be made while not departing from the scope of the present application.

FIGS. 1A-1D illustrate an example system 100 for supporting a suspended apparatus, which includes a hanging bracket 110 and a receiver unit 130. As shown in FIGS. 1A-1D, the receiver unit 130 is oriented and positioned for mating with the hanging bracket 110. The hanging bracket 110 without the receiver unit 130 illustrated in FIG. 2, and the receiver unit 130 without the hanging bracket is illustrated in FIGS. 3A-3C.

FIG. 1A includes an axes reference indicating the x-, y-, and z-directions. As described herein, the x-axis may be referred to as the "lateral axis," the y-axis may be referred to as the "longitudinal axis," and the z-axis may be referred to as the "vertical axis." These designations are provided for explanatory reasons, and do not necessarily imply a preferred orientation or configuration.

The hanging bracket 110 includes a flanged base that includes a first end 111 and a second end 112. In this example, the first end 111 and the second end 112 are separated by a gap 124 along the longitudinal axis. The gap 124 may, for example, provide clearance for wiring from the junction box to pass through the bracket 110 for connection to the ceiling fan and/or the receiver unit 130, among other purposes.

A first mounting slot 121 extends at least partially through the first end 111, and a second mounting slot 122 extends at least partially through the second end 112. The first mounting slot 121 and the second mounting slot 122 may enable the hanging bracket 110 to slideably engage with corresponding mounting hardware, such as screws extending from a mounting apparatus in the ceiling, such as junction box. It should be noted that the first mounting slot 121 and the second mounting slot 122 may or may not be included in the hanging bracket 110, or may have different shapes or dimensions, depending upon the particular implementation.

A first protrusion 119 extends laterally from the first end 111, and has included therethrough a first screw boss 117. Similarly, a second protrusion 120 extends laterally from the second end 112, which includes therethrough a second screw boss 118. The first screw boss 117 and the second screw boss 118 may be configured to receive screws or other fasteners, and may be shaped and sized appropriately for a particular type of fastener (e.g., a particular diameter, a specific screw threading type, etc.). The first protrusion 119 and the second protrusion 120 may be components that are joined or adhered to the first end 111 and the second end 112, respectively, or may be integrally formed with the first end 111 and the second end 112, respectively (e.g., milled from a single block of material, injection molded, 3D printed, etc.).

In some implementations, a support brace 123 may connect the first end 111 and the second end 112. The support brace 123 may be smoothly arced, or may have a polygonal or geometric shape, such as the one shown in FIGS. 1A-1D. The support brace 123 may, in some instances, be a separate component that is joined, adhered, or otherwise coupled to the first end 111 and the second end 112. In other instances, the support brace 123 may be integrally formed with the first end 111 and the second end 112. The support brace 123 may serve to reinforce the rigidity of the hanger bracket 110, to resist deformation when experiencing a torque.

The hanging bracket 110 also includes a support portion 115 vertically spaced from the first end 111 and the second end 112. The support portion 115 (also referred to herein as the "collar" 115) may be substantially circular in shape with a gap that permits the receipt of a hanging ball and downrod assembly. The collar 115 may be implemented as an open annulus, a C-shaped ring, or the like, and in some cases may have an inner surface 116 that is convex in shape (e.g., for receiving a spherical or ellipsoid hanging ball).

The hanging bracket 110 also includes a neck extending from the base to the collar 115. In this example, the neck is formed from a first portion 113 extending between and rigidly coupling the first end 111 to a portion of the collar 115, and a second portion 114 extending between and rigidly coupling the second end 112 to a portion of the collar 115. However, in other implementations the neck may be formed from a single continuous piece of material. Additionally, the neck may be joined to or integrally formed with the first end 111, the second end 112, and the collar 115.

The hanger bracket 110 may be formed from any suitable material, such as metal or plastic. In some implementations, the hanger bracket 110 is formed from plastic via injection molding, such that the first end 111, the second end 112, the first portion 113, the second portion 114, the collar 115, and other elements of the hanger bracket 110 are integrally formed. The hanger bracket 110 may include slots, gaps, or other voids to reduce the weight and/or amount of material used to construct the hanger bracket 110. One of ordinary skill in the art would appreciate that the hanger bracket 110 may be formed from a variety of manufacturing techniques.

The first screw boss 117 and the second screw boss 118 may enable additional hardware to be mounted to the hanger bracket 110, such as the receiver unit 130. In an example, the hanger bracket 110 is asymmetrical across the longitudinal axis, having a support brace 117 on one side and a substantially flat interface area (e.g., surfaces 125 and 126 shown on FIG. 2) on the opposite side. Such an interface—which may be formed from one or more substantially coplanar vertical surfaces of the first end 111, the second end 112, the first portion 113, and/or the second portion 114—may collectively provide surfaces that are complementary to corresponding surfaces of the receiver unit 130, permitting the hanging bracket 110 to be tightly abutted against the receiver unit 130.

Figure 2:
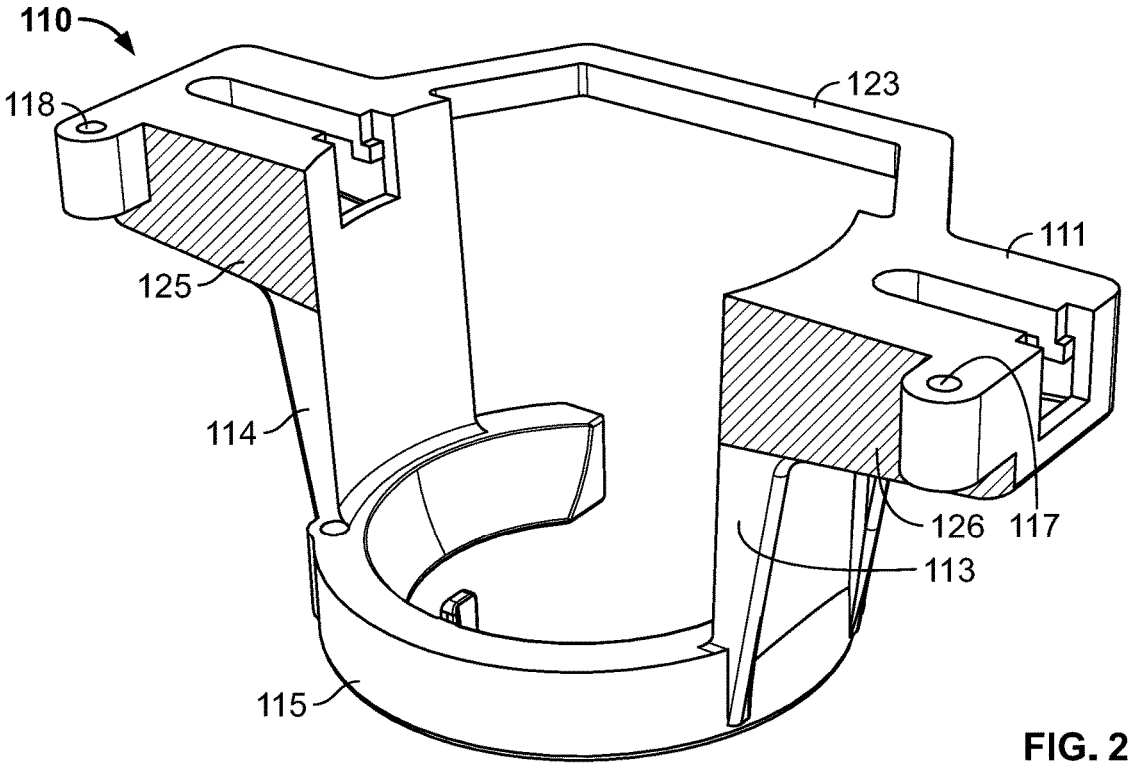
FIG. 2 is a rear perspective view of a ceiling fan hanger bracket, according to an example embodiment.
Figure 3A:
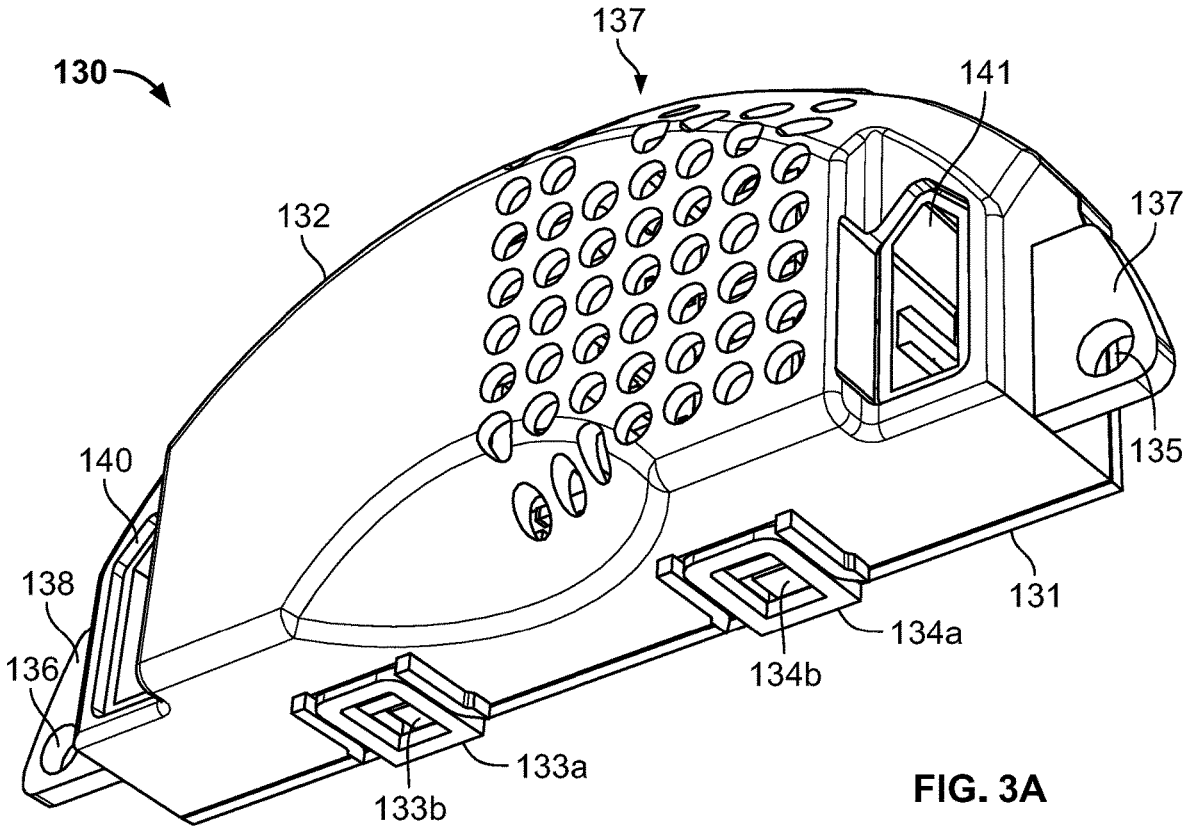
FIG. 3A is a front perspective view of a ceiling fan control unit, according to an example embodiment.
Figure 3B:
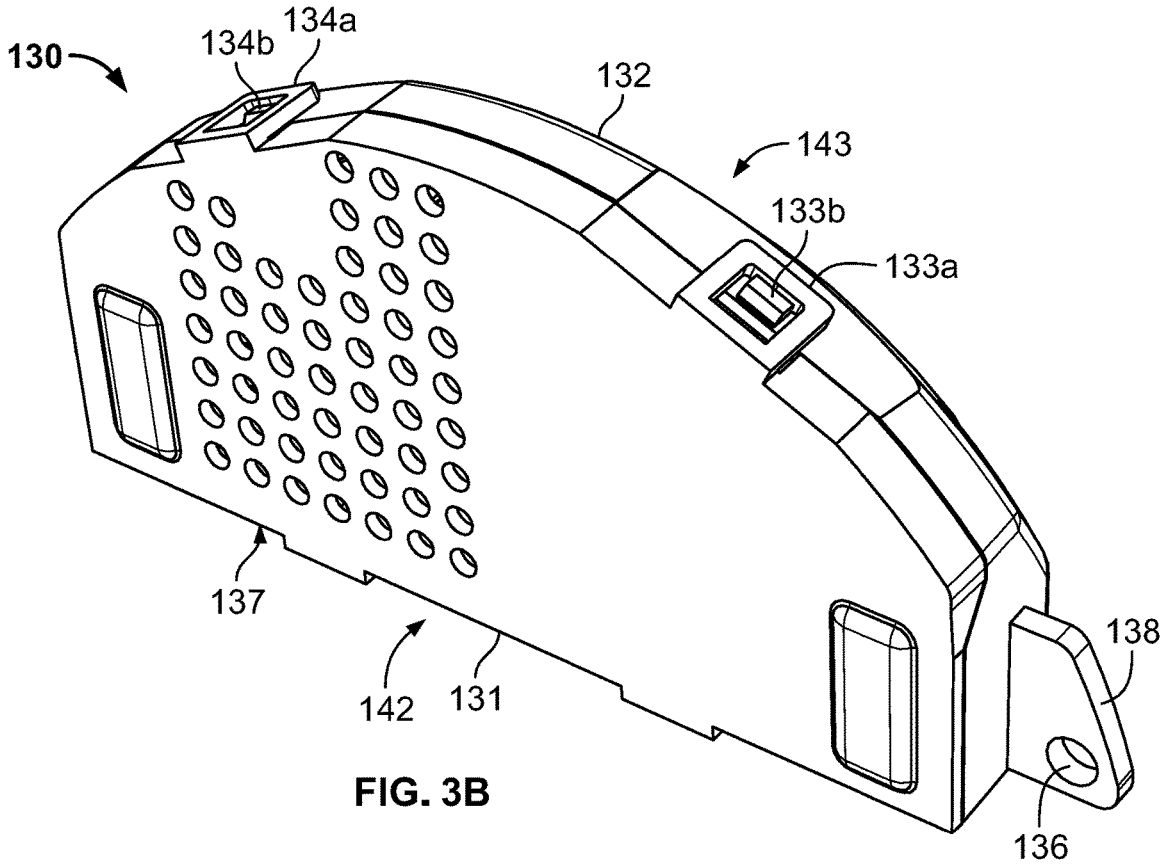
FIG. 3B is a rear perspective view of a ceiling fan control unit, according to an example embodiment.
Figure 3C:
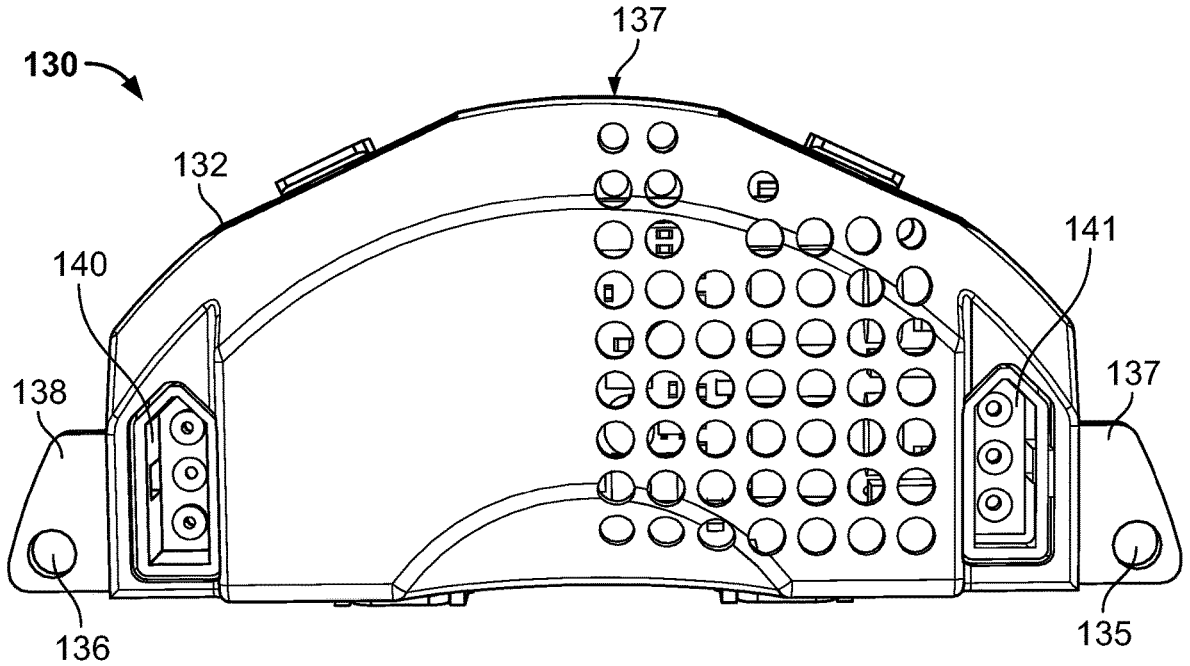
FIG. 3C is an elevated front view of a ceiling fan control unit, according to an example embodiment.

Referring now to FIG. 2, an interface comprised of surfaces 125, 126 is adapted for juxtaposition with a substantially flat portion 142 of the receiver unit 130 (see FIG. 3B). The interface includes at least a portion of the vertical surfaces of the first end 111 and the second end 112 of the base. The interface may also include a portion of the vertical surfaces of the first portion 113 and the second portion 114 of the neck, depending on the dimensions of the receiver unit 130. In some implementations, all of the surfaces that form the "interface" may be substantially coplanar, in that a flat element can be arranged flush with the interface.

In other implementations, the surfaces forming the interface may not necessarily be coplanar, and may instead take on a variety of non-flat geometries. In such implementations, a portion of the receiver unit 130 may be complementarily shaped, such that the complementary portion of the receiver unit 130 can be mated with the non-flat interface of the hanging bracket 110. The shape of the interface and the complementary shape of receiver unit 130 may selected based on design constraints, the electronic components integrated within the housing, cooling considerations, aesthetic effect, ease of installation, cost of manufacturing, durability, and/or any other factor.

The interface surfaces of the bracket 110 may define a "keep out area" of the bracket 110, which is a planar region that includes portions of the vertical surfaces of the base and neck of the hanging bracket 110. It should be understood that the "keep out area" may extend beyond the surfaces of the hanging bracket 110, and may include space between, below, or above those surfaces. Such spaces may accommodate portions of the receiver unit (e.g., locking tabs on the receiver unit extending partially into the gap between opposing base and/or neck portions of the hanging bracket 110).

Referring now to FIGS. 3A-3C, an example receiver unit 130 is shown that includes a housing that may, for example, further include a base portion 131 and a cover portion 132, which are removably secured to each other via push tabs 133*a*, 134*a* engaging with corresponding protrusions 133*b*, 134*b*. At least one of the base portion 131 and the cover portion 132 may have secured or mounted thereto an electronics assembly (e.g., a printed circuit board with electrical components coupled thereto). The base portion 131, the cover portion 132, or both may include one or more orifices 137, which serve as cooling vents for the electronics assembly. These orifices 137 may be positioned at or near electronic components known to likely produce heat during operation.

Other implementations of the receiver unit 130 might be formed from a single piece of material (e.g., molded plastic with a living hinge to enable the opening and closing of the housing), or could be formed from three or more separate portions.

Additionally, some receiver unit 130 implementations may include differently-shaped orifices 137 (e.g., square holes, triangular holes, slits, etc.). Alternatively or additionally, a receiver unit 130 might include additional cooling apparatuses, such as a fan, liquid cooling tubes, or heat sinks, among other suitable cooling apparatuses. Some implementations may not include orifices 137 as well.

The receiver unit 130 may have a shape and size that is complementary to the geometry of the hanging bracket 110, such that the substantially flat portion 142 of the receiver unit 130 can flushly abut an interface portion of the hanging bracket 110. Additionally, the receiver unit 130 includes a substantially arced portion 143 opposite the flat portion 142. When the receiver unit 130 is mated with the hanging bracket 110 (e.g., the flat portion 142 abuts the interface of the hanging bracket 110), the arced portion 143 extends laterally outward in a way that does not physically interfere with the placement of a fan canopy over the bracket and control unit assembly. As one example, the arced portion 143 is shaped as a circular arc, which can be contained within a circular or spherical canopy. Likewise, the support brace 123 of the hanging bracket 110 may, in some implementations, extend laterally outward in a direction opposite the arced portion 143, such that the collective volume of the support assembly 100 can be contained within the hollow cavity of a canopy cover. For example, dashed line 155 in FIG. 1D approximates the inner diameter of an example canopy base, and dashed line 150 approximates the cross section profile of the canopy.

Once assembled, the receiver unit 130 may be disposed outside of a vertical axis defined by a fan downrod and/or the collar 115 of the hanging bracket 110. This permits open and unobscured access to the electrical wiring in the junction box, as contrasted with conventional mounting techniques that involve loosely placing the receiver unit 130 into the void defined by the space between the first end 111 and the second end 112 of the base, the first portion 113 and the second portion 114 of the neck, and/or the central gap within the collar 115.

The receiver unit 130 includes mounting hardware that serves to secure the receiver unit 130 to the hanging bracket 110, thereby forming the support assembly 100. In this example, the receiver unit 130 includes tabs 137, 138 which include screw holes 135, 136. When the receiver unit 130 is oriented for mating with the hanging bracket 110, the screw holes 135, 136 align with the corresponding screw bosses 117, 118, such that a single screw may be driven through each screw hole-screw boss pair. The screw bosses 117, 118 may be "inboard," such that when the bracket is mounted to the ceiling, the bosses extend away from, and not into, the junction box.

In some embodiments, the receiver unit 130 may include, additionally or alternatively to push tabs 133*a*, 134*a* and the corresponding protrusions 133*b*, 134*b*, other types of fasteners that permit selective coupling of the base portion 131 and the cover portion 132.

The receiver unit 130 may also include one or more connectors 140, 141 (e.g., Molex plugs, proprietary ports, etc.) thereon. A supply-side connector (e.g., connector 140) may be coupled to a wiring harness that in turn interfaces with line power to thereby supply power to the electronics assembly within the receiver unit 130 (e.g., from AC mains power from a wall switch) and/or the ceiling fan itself (e.g., the ceiling fan motor, light bulbs, etc.). A fan-side connector (e.g., connector 141) may be coupled to a different wiring harness that in turn interfaces with components within a ceiling fan. For example, the fan-side connector may include wires for powering the light bulbs within a ceiling fan and the motor that drives the ceiling fan. The fan-side connector may serve to selectively supply a controlled level of power to each of these components within the ceiling fan. The integrated connectors 140, 141 are advantageous over flying leads and twist-on connectors because they reduce the likelihood of a user mis-wiring (e.g., by providing connector genders that are non-reversible) the receiver unit 130, and because they provide a consistent, mechanically-secure electrical connection. The connectors 140, 141 may include hardware (e.g., push tabs, levers, etc.) for mechanically securing wiring harnesses in place therein.

The cover portion 132 may enclose the electronics assembly to reduce its exposure to the environment. Like the base portion 131, the cover portion 132 may include orifices 137 thereon to provide additional cooling to the electronics assembly. In some implementations, the cover portion 132 includes gaps or cutouts that expose the control unit connectors 140, 141. This allows wiring harnesses to be engaged and disengaged from the receiver unit 130 without having to first remove the cover portion 132. The cover portion 132 may also include the one or more flanges or tabs 137, 138 extending outwardly from the housing, which include thereon screw holes 135, 136. The flanges or tabs 137, 138 may be arranged such that the screw holes 135, 136 on those flanges or tabs align with the screw bosses 117, 118 on the hanging bracket 110.

The receiver unit 130 may include electrical components that facilitate the control of the ceiling fan and constituent components. In some cases, a ceiling fan may include a motor that drives the rotation of the ceiling fan blades and one or more light bulbs. The receiver unit 130 may include therein electrical components operable to drive the ceiling fan motor and power those one or more light bulbs. For example, some control units may include a TRIAC or other voltage or current control devices for controlling the speed of the ceiling fan motor. Some control units may also include electrical components to step up, step down, rectify, or otherwise modify an input power sources voltage and/or current to be compatible with the light bulbs of the ceiling fan.

The receiver unit 130 may also include electrical components to enable communication with a remote control. For example, a receiver unit 130 may include therein an internal coiled antenna for receiving signals or messages (e.g., wired or wirelessly) from a remote control device. The receiver unit 130 may include any combination of microcontrollers, processors, or other processing devices for interpreting received signals from the remote control and facilitate the instructed operation from the remote control.

The hanging bracket 110 and receiver unit 130 may be provided as a premade assembly. This allows the ceiling fan hanger assembly 100 to be sold as a preassembled unit for easy installation.

Figure 4:
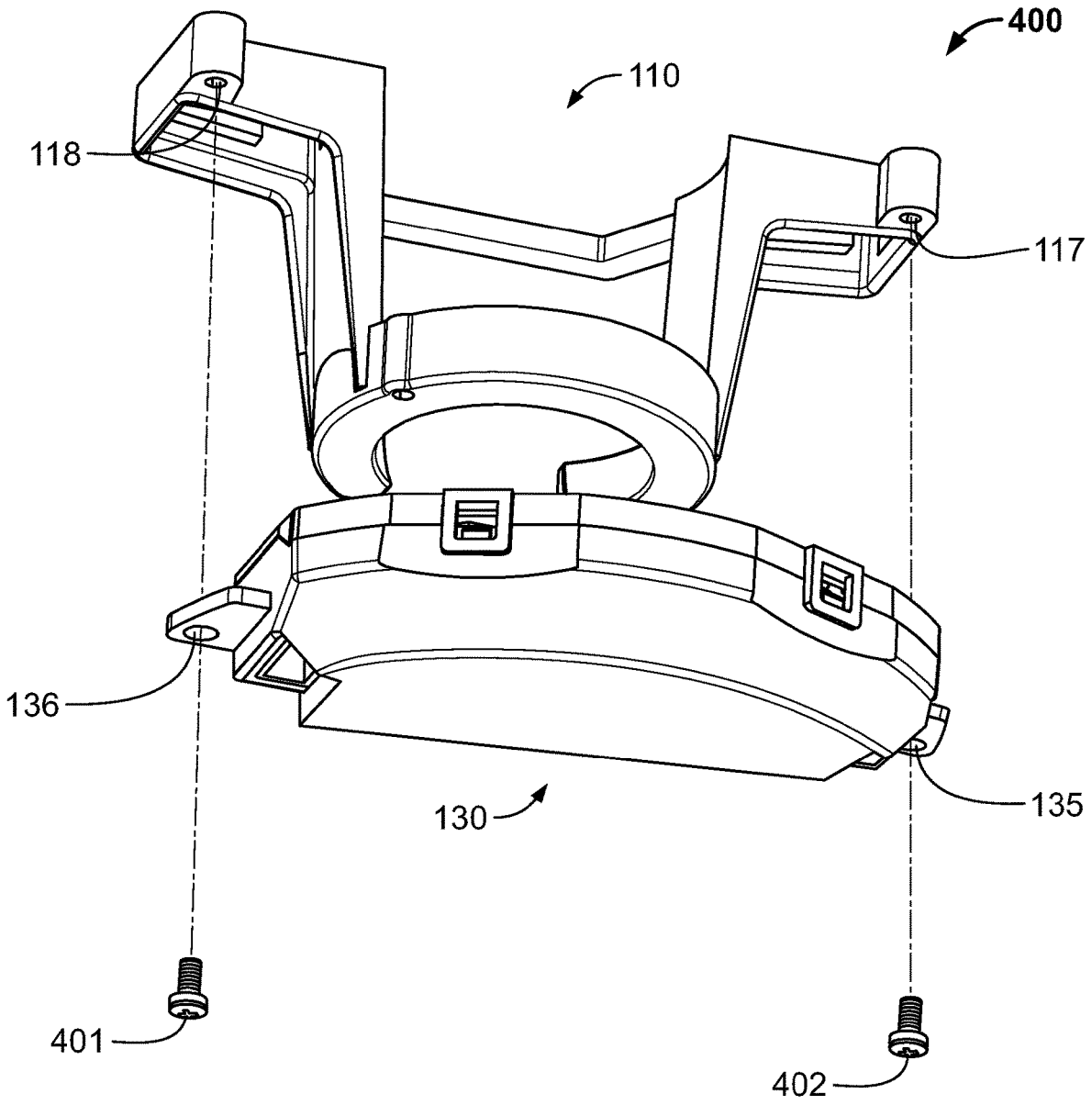
FIG. 4 is an exploded ceiling fan hanger bracket and control unit, according to an example embodiment.

FIG. 4 is an example exploded diagram 400 illustrating an example assembly method, in which the receiver unit 130 is oriented for alignment with the interface of the hanging bracket 110, such that the screw bosses 117, 118 and the screw holes 135, 136 respectively align. In this manner, a screw 401 can be driven through the screw hole 136 and into the screw boss 118, which may be threaded to enable the screw 401 to be rotateably secured into the screw boss 118. Likewise, a screw 402 can be driven through the screw hole 135 and into the screw boss 117, which may also be threaded to enable the screw 402 to be rotateably secured into the screw boss 117.

Although certain example methods and apparatus have been described herein, the scope of coverage of this disclosure is not limited thereto. On the contrary, this disclosure covers all methods, apparatus, and articles of manufacture fairly falling within the scope of the appended claims either literally or under the doctrine of equivalents.

It should be understood that arrangements described herein are for purposes of example only. As such, those skilled in the art will appreciate that other arrangements and other elements (e.g. machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

We claim:

1. A hanging bracket for supporting a suspended apparatus and a control unit housing, the hanging bracket comprising:

a base having a first end and a second end, the first end having a proximal end and a distal end, the second end having a proximal end and a distal end, the first end comprising a first screw boss protruding from the distal end and a first vertical surface extending unobstructed substantially between the proximal end and the first screw boss, and the second end comprising a second screw boss protruding from the distal end and a second vertical surface extending unobstructed substantially between the proximal end and the second screw boss, wherein the first vertical surface has a first width and the second vertical surface has a second width;

a support portion vertically spaced from the base, the support portion adapted to support the suspended apparatus; and a neck extending between the base and the support portion, the neck comprising (i) a first portion rigidly coupled between the first end of the base and the support portion, and (ii) a second portion rigidly coupled between the second end of the base and the second portion, the first portion having a third vertical surface substantially coplanar with the first vertical surface, the third vertical surface having a third width that does not exceed the first width, the second portion having a fourth vertical surface substantially coplanar with the second vertical surface, the second vertical surface having a fourth width that does not exceed the second width, wherein at least the first vertical surface of the first end of the base, the second vertical surface of the second end of the base, and the first and second screw bosses collectively form an interface, and wherein the hanging bracket and the control unit housing, when juxtaposed against each other, are adapted for containment within a canopy cover.

2. The hanging bracket of claim 1, wherein the support portion is a collar shaped as an open annulus having a concave inner surface.

3. The hanging bracket of claim 1, wherein the hanging bracket further comprises a support brace rigidly coupled between the first end of the base and the second end of the base.

4. The hanging bracket of claim 3, wherein the support brace is integrally formed with the first end of the base and the second end of the base.

5. The hanging bracket of claim 1, wherein the first portion of the neck extends from the first proximal end to the support portion, and wherein the second portion of the neck extends from the second proximal end to the support portion.

6. The hanging bracket of claim 1, wherein the first end of the base and the second end of the base are separated by a first gap having a first width along a horizontal axis, wherein the first portion of the neck and the second portion of the neck are separated by a second gap having a second width along the horizontal axis, and wherein the first width is substantially the same as the second width.

7. The hanging bracket of claim 1, wherein the base includes a gap separating the first end from the second end along a longitudinal axis.

8. The hanging bracket of claim 7, wherein the gap separating the first end of the base from the second end of the base has a width along the horizontal axis, wherein the support portion has an inner radius, and wherein the width of the gap is substantially the same as the inner radius of the support portion.

9. The hanging bracket of claim 1, wherein the base, the support portion, and the neck are integrally formed.

10. The hanging bracket of claim 1, wherein a collar of the hanging bracket is configured to maintain a hanger ball of a ceiling fan downrod.

11. The hanging bracket of claim 1, wherein a first protrusion extends from the first vertical surface proximate to the distal end of the first end of the base, wherein a second protrusion extends from the second vertical surface proximate to the distal end of the second end of the base, wherein the first screw boss is formed within the first protrusion, and wherein the second screw boss is formed within the second protrusion.

12. The hanging bracket of claim 1, wherein the support portion comprises a collar adapted to support the suspended apparatus, the collar having an axis passing therethrough, and wherein the control unit housing is disposed outside of the axis when complementary surfaces and screw holes of the control unit housing are juxtaposed with the interface.

13. The hanging bracket of claim 1, wherein a longitudinal axis extends through the first and second ends of the base, wherein the first end includes a first mounting slot extending along the longitudinal axis and a first protrusion extending in a direction perpendicular to the longitudinal axis, wherein the first protrusion includes therethrough the first screw boss, and wherein the second end includes a second mounting slot extending along the longitudinal axis and a second protrusion extending in a direction perpendicular to the longitudinal axis, wherein the second protrusion includes therethrough the second screw boss.

14. A system for supporting a ceiling fan having a downrod, the downrod defining an axis therethrough, the system comprising:

a hanging bracket comprising:

a base having a first end and a second end, the first end having a proximal end and a distal end, the second end having a proximal end and a distal end, the first end comprising a first vertical surface and a first screw boss protruding from the distal end, the first vertical surface extending unobstructed substantially between the proximal end and the first screw boss, and the second end comprising a second vertical surface and a second screw boss protruding from the distal end, the second vertical surface extending unobstructed substantially between the proximal end and the second screw boss, wherein the first vertical surface has a first width and the second vertical surface has a second width;

a support portion vertically spaced from the base, the support portion adapted to support the ceiling fan; and a neck extending between the base and the support portion, the neck comprising (i) a first portion rigidly coupled between the first end of the base and the support portion, and (ii) a second portion rigidly coupled between the second end of the base and the second portion, the first portion having a third vertical surface substantially coplanar with the first vertical surface, the third vertical surface having a third width that does not exceed the first width, the second portion having a fourth vertical surface substantially coplanar with the second vertical surface, the second vertical surface having a fourth width that does not exceed the second width; and a control unit housing having a first section configured for juxtaposition with the first vertical surface of the first end of the base, a second section configured for juxtaposition with the second vertical surface of the second end of the base of the hanging bracket, and screw holes to collectively enable coupling of the control unit housing with the hanging bracket, wherein the control unit housing, when coupled with the hanging bracket, does not intersect an axis.

15. The system of claim 14, wherein the control unit housing comprises:

a base portion configured to maintain thereon an electronics assembly; and a cover portion configured to engage with the base portion, wherein outer edges of the base portion are substantially complementary to outer edges of the cover portion.

16. The system of claim 15, wherein the base portion includes one or more first fastening elements, and wherein the cover portion includes one or more second fastening elements operable to selectively engage with the respective one or more first fastening elements to rigidly couple the base portion and the cover portion.

17. The system of claim 15, wherein the base portion includes one or more orifices configured to permit air flow for cooling of the electronics assembly.

18. The system of claim 15, wherein the base portion includes one or more connectors each operable to electrically engage with a corresponding wiring harness, wherein the cover portion includes one or more connector openings, and wherein, when the outer edges of the cover portion are engaged with the outer edges of the base portion, the one or more connector openings are in substantial alignment with the respective one or more connectors.

19. The system of claim 15, wherein the control unit housing further comprises:

a first tab proximate to the first section and extending from the control unit housing, wherein the first tab includes therethrough a first screw hole; and a second tab proximate to the second section extending from the control unit housing, wherein the second tab includes therethrough a second screw hole, wherein, when the first section of the control unit housing is juxtaposed with the first vertical surface of the first end of the base, the first screw hole and the first screw boss are in substantial alignment, and wherein, when the second section of the control unit housing is juxtaposed with the second vertical surface of the second end of the base, the second screw hole and the second screw boss are in substantial alignment.

20. The system of claim 15, wherein the electronics assembly is configured to control a motor of the ceiling fan suspended from the hanging bracket.

21. The system of claim 15, wherein the electronics assembly is configured to control one or more lighting elements of the ceiling fan suspended from the hanging bracket.

22. The system of claim 15, wherein the control unit housing includes a substantially flat portion and a substantially arced portion, wherein the flat portion includes the first and second sections of the control unit housing and is adapted for juxtaposition against the hanging bracket, and wherein the arced portion extends from the flat portion and is complementarily shaped for concealment within a canopy that substantially surrounds the hanging bracket and the control unit housing.

23. The system of claim 14, wherein the support portion comprises a collar adapted to support the ceiling fan, the collar having the axis passing therethrough, and wherein the control unit housing is disposed outside of the axis when complementary surfaces and screw holes of the control unit housing are juxtaposed with the interface.

24. The system of claim 14, wherein a longitudinal axis extends through the first and second ends of the base, wherein the first end includes a first mounting slot extending along the longitudinal axis and a first protrusion extending in a direction perpendicular to the longitudinal axis, wherein the first protrusion includes therethrough the first screw boss, and wherein the second end includes a second mounting slot extending along the longitudinal axis and a second protrusion extending in a direction perpendicular to the longitudinal axis, wherein the second protrusion includes therethrough the second screw boss.

* * * * *